United States Patent [19]

Holmström

[11] 4,343,402

[45] Aug. 10, 1982

[54] PARALLELEPIPEDIC PACKING CONTAINER PROVIDED WITH AN OPENING ARRANGEMENT

[75] Inventor: Sven N. H. Holmström, Slogstorp, Sweden

[73] Assignee: Tetra Pak International AB, Lund, Sweden

[21] Appl. No.: 105,915

[22] Filed: Dec. 21, 1979

[30] Foreign Application Priority Data

Jan. 15, 1979 [SE] Sweden ..... 7900315

[51] Int. Cl.[3] ..... B65D 5/74

[52] U.S. Cl. ..... 206/622; 229/7 R; 229/17 R

[58] Field of Search ..... 229/17 R, 7 R; 206/620, 206/621, 622; 53/451

[56] References Cited

U.S. PATENT DOCUMENTS

| | | | |
|---|---|---|---|
| 2,385,897 | 10/1945 | Waters | 53/451 X |
| 3,232,514 | 2/1966 | Swede et al. | 229/17 R |
| 3,717,244 | 2/1973 | Smith | 53/451 X |
| 3,797,726 | 3/1974 | Reil | 229/17 R |
| 4,088,260 | 5/1978 | Stark et al. | 229/17 R |
| 4,248,351 | 2/1981 | Berg | 229/17 R X |

FOREIGN PATENT DOCUMENTS

| | | |
|---|---|---|
| 213171 | 5/1967 | Sweden . |
| 324132 | 5/1970 | Sweden . |
| 324986 | 6/1970 | Sweden . |

*Primary Examiner*—Stephen Marcus

*Attorney, Agent, or Firm*—Burns, Doane, Swecker & Mathis

[57] ABSTRACT

A parallelepipedic packing container of the type which is provided with a sealing fin which extends over the upper end wall of the packing container as well as over triangular, double-walled lugs adjoining this end wall. The sealing fin comprises a narrow sealing zone on the outer edge of the fin and a tearing perforation on the base line of the fin, the tearing perforation extending from the tip of one triangular lug to a point on the end wall of the packing container. The sealing fin is unsealed in the area between the narrow sealing zone and the tearing perforation, and moreover a corresponding sealing fin arranged at the base of the packing container is appreciably narrower than the sealing fin wherein the tearing perforation is arranged.

8 Claims, 4 Drawing Figures

PARALLELEPIPEDIC PACKING CONTAINER PROVIDED WITH AN OPENING ARRANGEMENT

BACKGROUND AND SUMMARY OF THE PRESENT INVENTION

The present invention relates to parallel-epipedic packing containers of the type having a tearable opening arrangement.

In the manufacture of packing containers, e.g. those which are used in connection with the distribution of milk and similar products, the packing containers are manufactured such modern high-capacity packing machines in that a web of a packing material consisting e.g. of a plastic-coated carrier layer of paper is converted to a tube by joining the longitudinal edges of the web to one another, whereupon the tube is filled with contents and is divided by repeated flattening and sealing in zones situated at a distance from one another transverse to the longitudinal axis of the tube. In connection with the sealing of the tube the same is subjected to a forming process so that the packing containers obtain a tetrahedral or parallelepipedic shape. In those cases where a parallelepipedic shape is imparted to the packing containers, the packing containers will have two flattened sealing fins located along opposite end walls. The sealing fins extend over the said end walls as well as the triangular double-walled lugs adjoining these which are produced during the forming of the package.

It is known that in connection with the said triangular double-walled lugs and with the sealing fin different types of tearing perforations can be arranged, with the help of which an emptying opening for the package can be created. An example of such a tearing perforation is contained in Swedish Pat. No. 213,171, where the tearing perforation is arranged in such a manner that it is at right angles in relation to the fin and crosses over a part of the triangular lug as well as over the upper end wall. A pouring opening of the type which is described in the aforementioned Swedish patent specification has proved to function well, but it nevertheless gives rise to a few problems which may prove troublesome to the user of the packing container. In the first place, on prying open the tearing perforation the triangular lug which bears the perforation on the one hand has to be raised, while on the other hand it has to be flattened in a plane perpendicularly to the normal plane of the lug. The flattening is achieved by compressing the lug by pressure being applied between the outer converging lateral edges. Secondly, the pouring opening obtained cannot be reclosed in such a manner that the opening area can be substantially reduced so as to prevent e.g. dust and foreign particles from dropping into the packing container. These disadvantages can be overcome by a method and apparatus for a package design and an opening device in accordance with the present invention. In the present invention one of the said sealing fins is substantially broader than the other sealing fin. The broader sealing fin has a narrow sealing zone which extends along the whole length of the fin and is located close to the outer part of the sealing fin, along which the thermoplastic layers of the packing material placed against each other in the sealing fin have been caused to fuse together so as to form a tight and durable sealing joint. The braoder sealing fin has close to its base line, i.e., the connecting line to the said end wall and triangular lugs, a tearing perforation which penetrates through the outer layer of the packing material but not through its inner plastic layer. The tearing perforation is constituted of perforation lines in the packing material which lines are arranged so that on formation of the package they will be located parallel with one another and opposite one another in the sealing fin. The tearing perforation extends from the tip of one triangular lug to a point on the central portion of the end wall, and said broader sealing fin in the area between the sealing zones and the tearing perforation is unsealed.

BRIEF DESCRIPTION OF THE DRAWINGS

An embodiment of the invention will be described in the following with reference to the enclosed schematic drawing, wherein.

DETAILED DESCRIPTION OF THE PREFERRED EMBODIMENT

Figure 1:
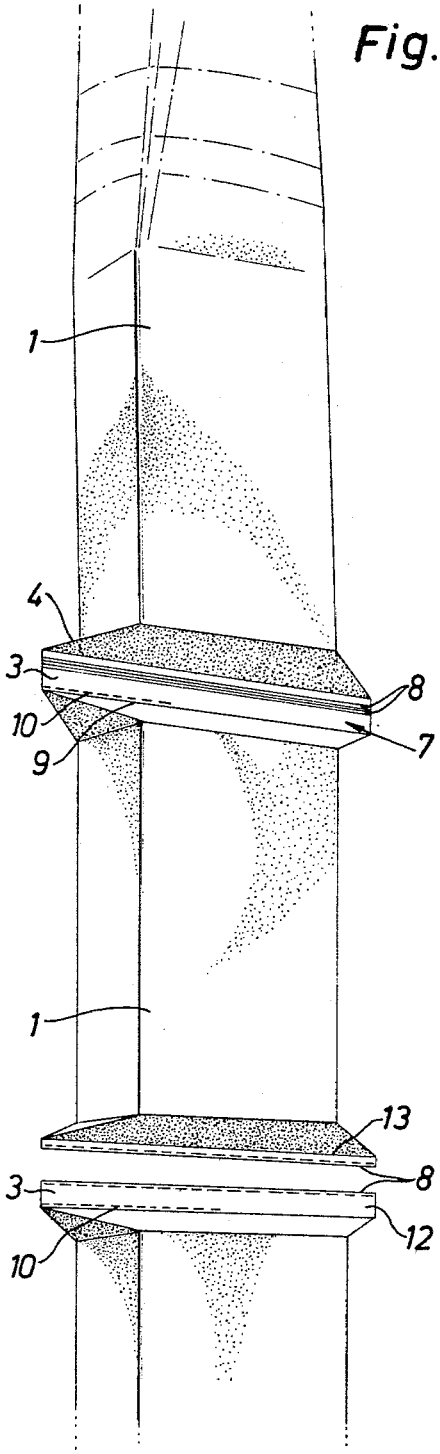
FIG. 1 is a perspective view of a portion of the packing material web during forming of the packing container.

With reference to FIG. 1, a tube 1 of packing material has been manufactured from a packing material web, formed into parallelepipedic packages, which are sealed and separated from the tube. In order not to encumber the figure with unnecessary details the forming devices of the packing machine have been omitted. Such forming devices are known, however, for example from Swedish Pat. Nos. 324,132 and 324,986.

As is evident from FIG. 1, in the formation of the parallelepipedic packages triangular, double-walled lugs 4 are produced which adjoin the flattened areas 7 as well as the end and side faces of the packing container.

When the tube formed from the packing material has been filled with the intended contents the tube is flattened in successive zones 7, the area between two zones being formed by folding of the packing material with the helping of forming devices not shown here. In each of the flattened areas 7 two narrow sealing zones 8, parallel but slightly separated from one another, are arranged, within which the inner plastic layers of the packing material are fused together to form a liquid-tight and durable sealing joint. In the packing material web a tearing perforation line 10 has been arranged in advance which during the formation of the web is guided so that it will be located within the flattened area 7 in the vicinity of a base line 9. The tearing perforation 10 is constituted of a perforation line arranged in the packing material. The perforation line penetrates through the outer layer of the packing material but not its inner plastic layer. By locating the tearing perforation line on the packing material web it is ensured that in the finished packing container the same will be situated within the flattened area 7 on either side of the said flattened area in such a manner that the perforation lines will be opposite one another.

The sealing zones 8 are arranged asymmetrically within the flattened area 7. The sealing zones 8 are arranged close to a side of the flattened area which is opposite the side on which the base line and the tearing perforation is arranged.

In the separation of the packing containers, which is also shown in FIG. 1, a cut is made through the packing material in the area between the sealing zones 8 which means that the separated packing containers will be given a broader sealing fin 12 and a narrower sealing fin 13. The sealing fin 12 is considerably broader than the sealing fin 13 and in any case has at least double the width. The packing containers which are manufactured in the manner which is illustrated in FIG. 1 are finished such that the triangular lugs are folded down against adjoining side walls and are fixed to the side walls. Also, at the base of the package the triangular lugs are folded in against the bottom end wall and sealed to the same, a packing container in accordance with FIG. 2 being formed.

Figure 2:
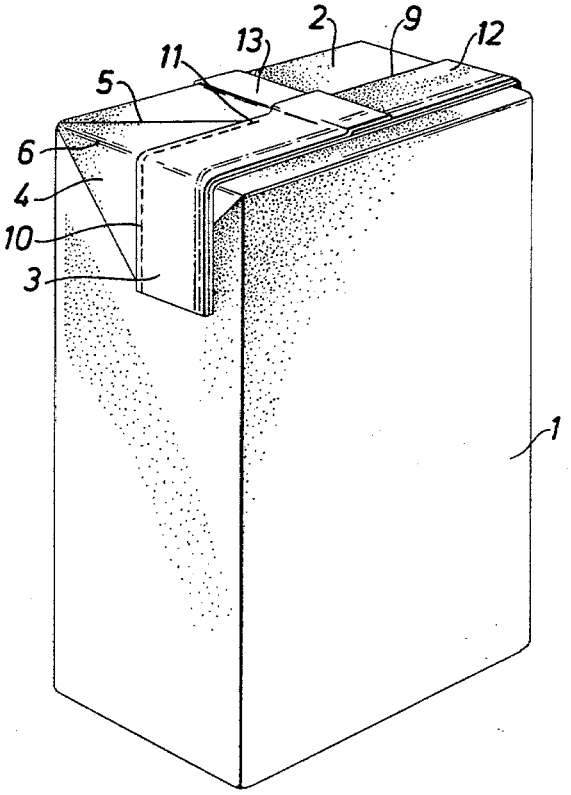
FIG. 2 is a perspective view of the unopened packing container in accordance with the invention.

The packing container shown in FIG. 2 is illustrated in perspective in such a manner that its base is not visible, but on the upper part of the packing container is shown the broader sealing fin 12 which on its outer part has a narrow sealing zone 8, within which the plastics-coated insides of the packing material are fused together to form a tight joint, which extends over the whole length of the sealing fin 12. In the sealing fin 12 moreover, a tearing perforation 10 is arranged close to the base line 9 of the sealing fin 12. This tearing perforation, which is found on both sides of the sealing fin 12, extends from the tip of the triangular lub 4 to a point on the central portion of the upper end wall 2 of the packing container. The sealing fin 12 extends along the whole of the upper end wall 2 and further over the two triangular lugs 4, which are connected along the folding line 6 of the upper end wall 2. Material layers in the area 3 of the sealing fin 12 between the sealing zone 8 and the tearing perforation 10 placed against each other can be separated from each other.

To facilitate the formation of a pouring spout on opening the package, the upper end surface 2 of the package is provided with crease lines 5, along which the parts of the package which are to form the pouring spout can easily be folded. The end point 11 of the tearing perforation 10 should be located at the point of convergence of the crease lines 5 or a little behind the same, but it preferably should not extend up to the longitudinal joint 15 which is the sealing joint which is formed when the weblike packing material is formed into a tube.

Figure 3:
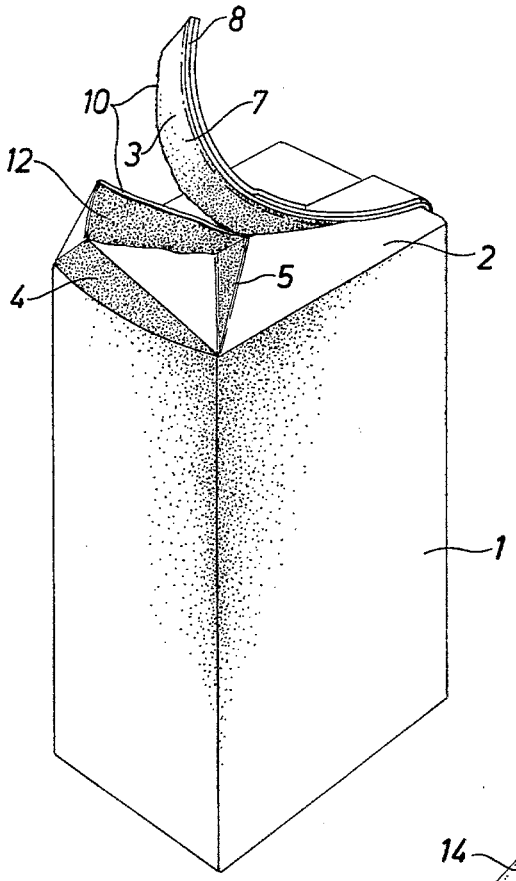
FIG. 3 is a perspective view of the opened packing container.

In FIG. 13 is shown how the packing container is opened in that the triangular lug 4 fixed to the side wall of the package is pried open, whereupon the broad fin 12 is folded up to a position substantially at right angles to the upper end wall 2 of the packing container, whereupon the outer part of the broad fin situated at the tearing perforation is gripped between the fingers and is torn off along the tearing perforation line 10. As a result a linear opening is formed which can be widened to rhomboid shape in the manner shown in FIG. 3 by lifting the lug 4 upwards at the same time as the parts of the packing material forming the pouring spout are folded about the crease lines 5. It has been found that a pouring spout which is formed in this manner gives rise to a dimensionally stable pouring spout with a large emptying opening. The part of the fin 12 torn off should be withdrawn from the pouring area, so that it does not come into contact with the contents during the pouring out of the same.

Figure 4:
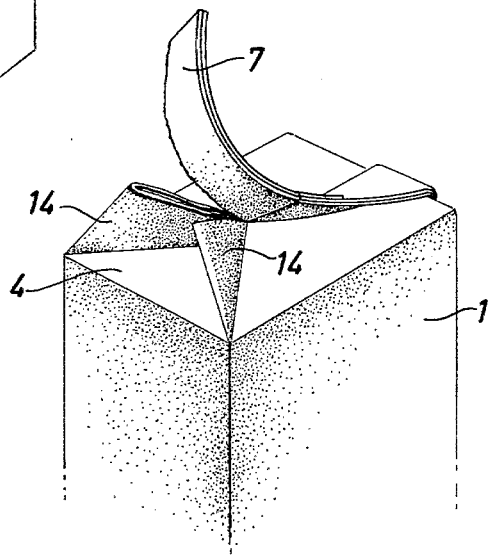
FIG. 4 is a perspective view of a partially reclosed packing container.

When the intended quantity of contents has been poured from the packing container the same can be closed so as to be dust-protected again, such that the bottom part of the triangular lug 4 is closed in a bellows-type manner over the emptying opening to a position behind or underneath the parts of the packing material which form the top side of the triangular lug. The reclosing method is illustrated in FIG. 4 and it has been found that by this reclosing process a stable state of closure is achieved. The packing containers can easily be reopened by moving the lugs 14 backwards as a result of which the underside of the triangular lug 4 snaps out again to form the emptying opening shown in FIG. 3.

It has been found that the package design in accordance with the invention has several advantages compared with previous similar package designs, and as mentioned before, it can be said that the packing containers can be opened more easily because the broad sealing fin 12 provides a prominent handling grip in the tearing up along the perforation, and it is also easy to reclose the packing container which for a long time has been an object desired by the users of packing containers. These advantages have been achieved without making the packing container more expensive by having to use more material or complicating the manufacturing process.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made without departing from the spirit of the present invention as defined in the appended claims.

What is claimed is:

1. A packing container comprising:

a top end wall and a bottom end wall and side walls;

first and second triangular lugs extending from opposite sides of the top end wall and overlapping the adjacent side walls;

a first sealing fin extending along the top end wall from the tip of the first lug to the tip of the second lug, said first sealing fin being double-walled and having a base edge adjoining said top end wall and a free edge spaced from said base edge, said first sealing fin having a sealing zone; and said first sealing fin also having a perforation along said base edge, said perforation extending from the tip of one lug to a central portion of the top end wall, said first sealing fin being folded down against the top end wall after being sealed along said sealing zone, said perforation being spaced from said sealing zone, said sealing zone being located closer to said free edge of said first sealing fin than to said perforation, and opposing interior faces of said double-walled fin being unsealed along said perforation.

2. The packing container of claim 1 wherein the packing container is formed from a packing material having at least one outer layer and at least one inner plastic layer and wherein the perforation comprises perforation lines extending along a common axis said perforation lines penetrating through the at least one outer layer of the packing material on opposite sides of the first sealing fin.

3. The packing container of claim 2 wherein facing inner thermoplastic layers of the packing material are fused along the sealing zone.

4. The packing container of claim 1 wherein the first sealing fin is greater than three times as wide as the zone sealing zone.

5. The packing container of claim 1 wherein the perforation extends along the top end wall for a length at least as great as the length of the perforation along the said one lug.

6. In a packing container having a top end wall, a bottom end wall and side walls, first and second triangular lugs extending from opposite sides of said top end wall and overlapping adjacent side walls and a sealing fin extending along said top end wall from a tip of said first lug to a tip of said second lug, the improvement comprising:

a sealing zone adjacent a free edge of said sealing fin, a perforation extending along a base edge of said sealing fin from the tip of one lug to near an intersection point of two crease lines located on said top wall, and an unsealed area in said sealing fin extending between said perforation and said sealing zone, and wherein said sealing fin is of substantial width in relation to the width of said sealing zone so that said unsealed area is at least as wide as said sealing zone.

7. The packing container of claims 1 or 6 wherein said perforation extends in a substantially straight line parallel to said base edge.

8. The packing container of claims 1 or 6 wherein said sealing fin is arranged to be gripped, near said tip of one lug from which said perforation extends, for pulling up thereon to tear said sealing fin along said perforation thereby defining a first wall panel joined to a side face of the packing container and a pair of second wall panels each joined to said first wall panel as well as to said top end wall of the packing container such that said pair of second wall panels may be spaced from each other along said crease lines in said top end wall to form a rhomboid-shaped pouring spout in the packing container.

* * * * *